US009322627B2

(12) United States Patent
Oh et al.

(10) Patent No.: US 9,322,627 B2
(45) Date of Patent: Apr. 26, 2016

(54) MUNITIONS SAFETY AND ARMING DEVICE FOR ARTILLERY AMMUNITION, AND ARTILLERY AMMUNITION HAVING THE SAME

(71) Applicants: Jong Soo Oh, Daejeon (KR); Seung Seob Lee, Daejeon (KR); Choon Jae Lee, Daejeon (KR); Kyoung Woong Seo, Gumi-si (KR); Dong Wan Lim, Daegu (KR)

(72) Inventors: Jong Soo Oh, Daejeon (KR); Seung Seob Lee, Daejeon (KR); Choon Jae Lee, Daejeon (KR); Kyoung Woong Seo, Gumi-si (KR); Dong Wan Lim, Daegu (KR)

(73) Assignee: AGENCY FOR DEFENSE DEVELOPMENT, Daejeon (KR)

( * ) Notice: Subject to any disclaimer, the term of this patent is extended or adjusted under 35 U.S.C. 154(b) by 0 days.

(21) Appl. No.: 14/493,449

(22) Filed: Sep. 23, 2014

(65) Prior Publication Data

US 2015/0253118 A1 Sep. 10, 2015

(30) Foreign Application Priority Data

Mar. 4, 2014 (KR) ..... 10-2014-0025732

(51) Int. Cl.
*F42C 15/26* (2006.01)
*F42C 15/22* (2006.01)

(52) U.S. Cl.
CPC ..... *F42C 15/22* (2013.01); *F42C 15/26* (2013.01)

(58) Field of Classification Search
CPC ..... F42C 15/18; F42C 15/184; F42C 15/22; F42C 15/24; F42C 15/26; F42C 15/34
USPC ..... 102/221–222, 231–233, 235, 237–238, 102/244–245, 254, 255
See application file for complete search history.

(56) References Cited

U.S. PATENT DOCUMENTS

| | | | | |
|---|---|---|---|---|
| 3,882,782 | A * | 5/1975 | Simmen | 102/238 |
| 6,568,329 | B1 * | 5/2003 | Robinson | 102/231 |
| 8,448,574 | B1 | 5/2013 | Robinson et al. | |
| 2010/0132577 | A1 | 6/2010 | Rastegar | |
| 2012/0192747 | A1 * | 8/2012 | Pisella et al. | 102/257 |

FOREIGN PATENT DOCUMENTS

KR 1020130115572 A 10/2013

* cited by examiner

*Primary Examiner* — Stephen M Johnson
*Assistant Examiner* — Benjamin Gomberg
(74) *Attorney, Agent, or Firm* — Scully Scott Murphy and Presser

(57) ABSTRACT

A munitions safety and arming device for artillery ammunition, and an artillery ammunition having the same are provided. The munitions safety and arming device for artillery ammunition includes: a body having a first movement path and a second movement path communicating with the first movement path; a mass body housed in the first movement path and moving from one side of the first movement path to the other side of the first movement path upon receiving centrifugal force based on rotation of an artillery ammunition when the artillery ammunition is fired; a slide member movably installed in the second movement path and slidably moving by a predetermined distance when pressed by the movement of the mass body; and a movement delay unit protruding from the first movement path to reduce the centrifugal force exerted on the mass body to delay a time for the mass body to move.

7 Claims, 8 Drawing Sheets

MUNITIONS SAFETY AND ARMING DEVICE FOR ARTILLERY AMMUNITION, AND ARTILLERY AMMUNITION HAVING THE SAME

CROSS-REFERENCE TO RELATED APPLICATION

Pursuant to 35 U.S.C. §119(a), this application claims the benefit of earlier filing date and right of priority to Korean Application No. 10-2014-0025732, filed on Mar. 4, 2014, the contents of which is incorporated by reference herein in its entirety.

BACKGROUND OF THE INVENTION

1. Field of the Invention

The present invention relates to a munitions safety and arming device installed in an artillery ammunition to delay an initiating preparation time of the artillery ammunition, and an artillery ammunition having the same.

2. Background of the Invention

In general, an artillery ammunition is used in an artillery weapon system and foot soldier weapon system. An artillery ammunition includes a fuze, and the fuze enables the artillery ammunition to be initiated under particular conditions.

Fuzes include a point detonating fuze installed in a nose of an artillery ammunition, which is directly hit to operate or detonate under predefined conditions when the artillery ammunition collides with a target or the ground, a base fuze installed on the bottom of an artillery ammunition to play the same role as that of the point detonating fuze, a contact fuze operating when brought into contact with a target, a super quick fuze detonated immediately when brought into contact with a target, a delay fuze, a sort of contact fuze, detonated a predetermined delay time after brought into contact with a target, a time fuze whose function time may be set in advance based on a fire point in time, a proximity fuze whose function time is adjusted by directly recognizing whether it has approached a predetermined distance from a target, and the like.

However, an artillery ammunition needs to be maintained in an absolutely safe state such that it is not detonated for a predetermined delay time after the artillery ammunition is released after fired, as well as during a process of handling, carrying, and transporting the artillery ammunition. To this end, a munitions safety and arming device is accommodated in the fuze.

The munitions safety and arming device disposes gunpowder, or the like, retained by a artillery ammunition to prevent the artillery ammunition from being easily detonated or allow a small amount of gunpowder to be detonated, if ever, to thus reduce damage at the time of detonation.

Korean Laid Open Publication No. 10-2013-0115572 discloses a mechanical safety and arming device. A rotational speed at which an artillery ammunition when flying is proportional to a velocity of an artillery ammunition. However, in the mechanical safety and arming device, after an artillery ammunition is rotated at a high speed and released from the muzzle of a gun, a detonation is ready in a state in which a sufficient safety distance is not secured, making it difficult to secure a sufficient distance in front of the muzzle of a gun.

Thus, a munitions safety and arming device capable of securing a sufficient safety distance before the muzzle of a gun to secure safety when an artillery ammunition is fired, and an artillery ammunition having the same may be considered.

SUMMARY OF THE INVENTION

Therefore, an aspect of the present invention is to provide a munitions safety and arming device for artillery ammunition capable of securing a sufficient safety distance before the muzzle of a gun even in an artillery ammunition having a fast rotational speed, and an artillery ammunition having the same.

Another aspect of the present invention is to provide a munitions safety and arming device for artillery ammunition that can be applied to a currently operated military-use artillery ammunitions and smart artillery ammunitions that may be developed in the future, and an artillery ammunition having the same.

To achieve these and other advantages and in accordance with the purpose of this specification, as embodied and broadly described herein, there is provided a munitions safety and arming device for artillery ammunition, including: a body having a first movement path and a second movement path communicating with the first movement path; a mass body housed in the first movement path and moving from one side of the first movement path to the other side of the first movement path upon receiving centrifugal force based on rotation of an artillery ammunition when the artillery ammunition is fired; a slide member movably installed in the second movement path and slidably moving by a predetermined distance when pressed by the movement of the mass body; and a movement delay unit protruding from the first movement path to reduce the centrifugal force exerted on the mass body to delay a time for the mass body to move.

According to one embodiment of the present invention, the body may include: a guide frame having a movement hole forming at least a portion of the first movement path and a second movement path; a cover disposed on one side of the guide frame and having a cover side movement path forming at least the other portion of the first movement path; and a base disposed on the other side of the guide frame and having a base side movement path forming at least the other portion of the first movement path, wherein the movement delay unit is disposed in at least any one of the guide frame, the cover side movement path, and the base side movement path.

According to another embodiment of the present invention, a plurality of movement delay units may be provided and disposed to be spaced apart from one another.

According to yet another embodiment of the present invention, the movement delay unit may include a cantilever protruding from one side of the first moving path toward the other side thereof.

The cantilever may include a deceleration portion decelerating a moving speed of the mass body and a constant speed portion maintaining a moving speed of the mass body decelerated by the deceleration portion.

According to still another embodiment of the present invention, in order to reduce a moving speed of the mass body through the deceleration portion or maintain a moving speed of the mass body through the constant speed portion, at least any one of the thickness of the cantilever and displacement from a surface of the first moving path to the cantilever may be changed.

In order to reduce a speed of the mass body, the deceleration portion may be formed to have a thickness increased toward a progress direction of the mass body, and in order to maintain a speed o the mass body, the constant speed portion may be formed such that displacement from the surface where the cantilever is formed to the constant speed portion is increased toward the progress direction of the mass body.

To achieve these and other advantages and in accordance with the purpose of this specification, as embodied and broadly described herein, there is also provided an artillery ammunition including: an artillery ammunition body fired by propellant powder; a body installed in the artillery ammunition body and having a first movement path with a support bar bent when an artillery ammunition is fired and a second movement path communicating with the first movement path; a mass body supported by the support bar before the artillery ammunition is fired, and housed in the first movement path as the support bar is bent when the artillery ammunition is fired, and moving from one side of the first movement path to the other side of the first movement path upon receiving centrifugal force based on rotation of the artillery ammunition; and a slide member movably installed in the second movement path, temporarily supported in the body by a stopping protrusion, and slidably moving by a predetermined distance when pressed by the movement of the mass body, wherein the body includes: a guide frame having a movement hole forming at least a portion of the first movement path and a second movement path; a cover disposed on one side of the guide frame and having a cover side movement path forming at least the other portion of the first movement path; and a base disposed on the other side of the guide frame and having a base side movement path forming at least the other portion of the first movement path; and a movement delay unit protruding from at least any one of the guide frame, the cover side movement path, and the base side movement path to reduce the centrifugal force exerted on the mass body to delay a time for the mass body to move.

According to the present invention having the foregoing configuration, since the movement delay unit reduces centrifugal force exerted on the mass body while the mass body is moving, a moving time of the mass body may be delayed. Thus, due to the delay of the moving time of the mass body, a sufficient safety distance before the muzzle of a gun may be secured even in an artillery ammunition fired at a fast speed.

Also, unlike a pressure-type or electric-type time delay device, the present invention as a simple mechanical time delay device, can be applied even to a military-use artillery ammunitions and smart artillery ammunitions.

BRIEF DESCRIPTION OF THE DRAWINGS

The accompanying drawings, which are included to provide a further understanding of the invention and are incorporated in and constitute a part of this specification, illustrate exemplary embodiments and together with the description serve to explain the principles of the invention.

In the drawings.

DETAILED DESCRIPTION OF THE INVENTION

Figure 1:
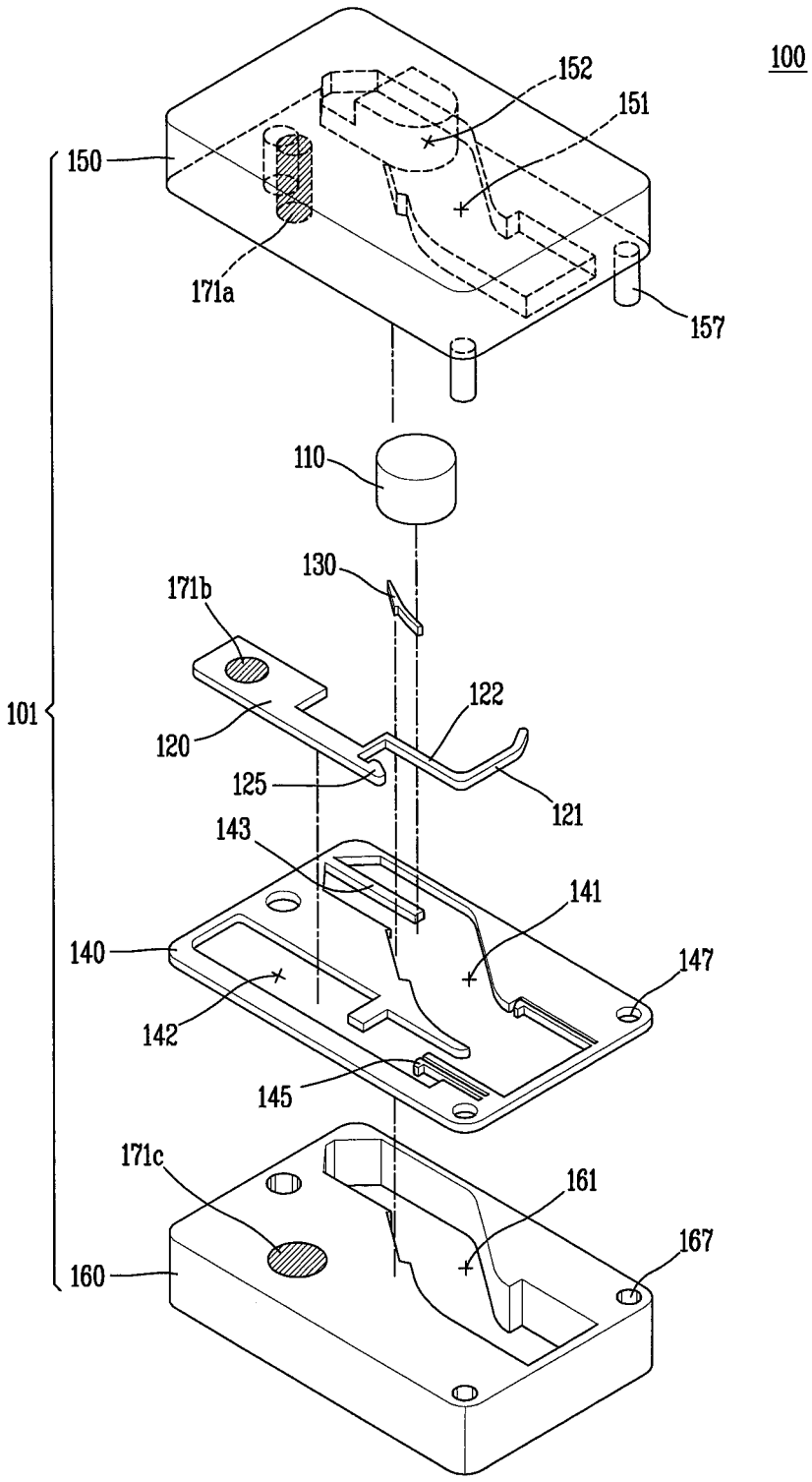
FIG. 1 is an exploded perspective view of a munitions safety and arming device for artillery ammunition according to the present invention.

Hereinafter, a munitions safety and arming device for artillery ammunition and an artillery ammunition having the same according to exemplary embodiment of the present invention will be described with reference to the accompanying drawings.

The same or like reference numerals were used for the same or like components although they are in different exemplary embodiments, and first descriptions thereof will used for the other descriptions. As used herein, the singular forms "a", "an" and "the" are intended to include the plural forms as well, unless the context clearly indicates otherwise.

A munitions safety and arming device for artillery ammunition is housed in an artillery ammunition to enable the artillery ammunition to be detonated after the artillery ammunition has moved a predetermined distance after being fired. That is, the munitions safety and arming device for artillery ammunition is a device for preventing an artillery ammunition from being detonated until when the artillery ammunition flies for a predetermined distance after it is produced and fired.

An artillery ammunition may be exposed to various external forces. For example, when the artillery ammunition is moved, transported, or mounted for being fired, the artillery ammunition may receive external force. In this case, there is a risk that the artillery ammunition is fired by external force applied from the outside, the foregoing munitions safety and arming device for artillery ammunition is provided.

However, when an artillery ammunition is fired and ready for being detonated before it flies by a predetermined distance from the location in which the artillery ammunition was fired, there is a possibility that the munitions safety and arming device for artillery ammunition is detonated, and thus, the munitions safety and arming device for artillery ammunition needs to be ready for detonation with a sufficient distance.

When an artillery ammunition is fired, it rotates, while flying. When the artillery ammunition rotates, centrifugal force according to the rotation serves as force for operating the munitions safety and arming device for artillery ammunition, and an angular velocity of rotation varies depending on a flying distance of the artillery ammunition. Thus, a fast rotation speed may quicken detonation preparation of the munitions safety and arming device for artillery ammunition. Thus, in order to delay the detonation preparation of the munitions safety and arming device for artillery ammunition, the munitions safety and arming device for artillery ammunition according to an exemplary embodiment of the present invention includes a movement delay unit.

Hereinafter, the munitions safety and arming device for artillery ammunition including the movement delay unit will be described.

FIG. 1 is an exploded perspective view of a munitions safety and arming device 100 for artillery ammunition according to the present invention.

The munitions safety and arming device 100 for artillery ammunition includes a body 101, a mass body 110, a slide member 120, and a movement delay unit 130.

The body 101 includes a first movement path allowing the mass body 110 to be movable therein and a second movement path 142 communicating with one side of the first movement path. Also, the body 101 may include a cover 150, a guide frame 140, and a base 160.

The guide frame 140 includes a movement hole 141 forming at least a portion of the first movement path and the second movement path 142. Also, the guide frame 140 may include a support bar 143 and the movement delay unit 130. The guide frame 140 includes a guide frame pin insertion hole 147. The support bar 143 serves to support the mass body 110 before an artillery ammunition is fired, and is bent in a direction opposite to a firing direction due to acceleration when the artillery ammunition is fired. As the support bar 143 is bent, the mass body 110 placed on the support bar 143 is housed into the first movement path and moves to an outer side of the artillery ammunition due to rotation of the artillery ammunition along the movement hole 141. The movement delay unit 130 is disposed in the first movement path and protrudes from the first movement path in order to reduce centrifugal force while the mass body 110 moves in the first movement path due to the centrifugal force based on rotation of the artillery ammunition.

The second movement path 142 is provided to communicate with one side of the first movement path, and the slide member 120 is disposed to be slid in the second movement path 142. Also, when the slide member 120 is disposed to be slid by the mass body 110, a guide frame coupling portion 145 is provided to fix the slide member 120. The guide frame coupling portion 145 has an end portion having a hook shape.

The cover 150 is disposed above the guide frame 140 to cover upper and lower sides of the guide frame 140 together with the base 160 from above and below. The cover 150 includes a cover side explosive 171*a*, a mass body holder 152, a cover side movement path 151, and a cover pin 157.

The cover side explosive 171*a* is part of explosives provided in an artillery ammunition including the munitions safety and arming device 100, and when the slide member 120 is moved by the mass body 110, the cover side explosive 171*a* is connected to explosive provided in the slide member 120 and the base 160 so as to be ready for detonation.

When the mass body 110 is supported by the support bar 143 provided in the guide frame 140, the mass body holder 152 serves to hold a portion of the mass body 110 protruded upwardly, and also serves to prevent the mass body 110 from being housed into the first movement path before the support bar 143 is bent, namely, before the artillery ammunition is fired.

The cover side movement path 151 is part of a path along which the mass body 110 moves. The path along which the mass body 110 moves is called a first movement path. The first movement path includes the cover side movement path 15, the movement hole 141 provided in the guide frame 140, and a base side movement path 161 provided in the base 160. In the drawing, it is illustrated that the movement delay unit is disposed in the movement hole 141 provided in the guide frame 140, but the present invention is not limited thereto and the movement delay unit 130 may be disposed in the cover side movement path 151.

The cover pin 157 is inserted into the guide frame pin insertion hole 147 of the guide frame 140 and the base 160 in order to integrate the cover 150, the guide frame 140, and the base 160.

The base 160 is disposed on the side opposite to the side where the cover 150 of the guide frame 140 is disposed, and includes the base side movement path 161 forming part of the first movement path. Also, when the slide member 120 moves, a base side explosive 171*c* is aligned with the cover side explosive 171*a* and a slide member side explosive 171*b*. The base 160 includes a pin insertion hole 167 allowing the cover pin 157 provided in the cover 150 to be inserted therein.

The mass body 110 is housed in the first movement path, and when an artillery ammunition is fired, the mass body 110 is moved from one side of the first movement path to the other side thereof due to centrifugal force based on rotation of the artillery ammunition. One side of the first movement path is where the support bar 143 is positioned, and the other side of the first movement path is where a vertical bar 121 of the slide member 120 is positioned. The munitions safety and arming device for artillery ammunition is manufactured to be miniaturized using an MEMS technique, and the mass body 110 may weigh, for example, about some grams. The mass body 110 may have a cylindrical shape or may have a globular shape so as to be easily moved.

The slide member 120 is installed to be slid in the second movement path 142. When the mass body 110 moves toward the other side of the first movement path, the mass body 110 may be brought into contact with the vertical bar 121 portion of the slide member 120, and thereafter, the mass body 110 presses the slide member 120 to enable the slide member 120 to move by a predetermined distance.

The slide member 120 includes the slide member side explosive 171*b*. When the slide member 120 moves by the predetermined distance, the slide member side explosive 171*b* may be aligned with the cover side explosive 171*a* and the base side explosive 171*c*.

Also, the slide member 120 includes the vertical bar 121 pushed as the mass body 110 is moved and a horizontal bar 122 connecting the slide member 120 body and the vertical bar 121. The slide member 120 includes a slide member coupling portion 125 fixedly coupling the guide frame 140 and the slide member 120 when the slide member 120 is moved to be slid by the mass body 110. The slide member coupling portion 125 may protrude to one side and have an end portion in a hook shape so as to be coupled with the guide frame coupling portion 145.

The movement delay unit 130 is formed to protrude in the first movement path in order to delay a movement time of the mass body 110. Also, the movement delay unit 130 may be disposed in at least any one of the guide frame 140, the cover side movement path 151, and the base side movement path 161. Also, in a case in which a movement time of the mass body needs to be lengthened, a plurality of movement delay units 130 may be provided.

The movement delay unit 130 may be a cantilever provided from one side of the first movement path to the other side thereof. This is because elastic force or the thickness of the movement delay unit 130 may attenuate centrifugal force exerted on the mass body 110. Also, the cantilever is a mechanical element, which may delay a movement time of the mass body 110, has a low possibility of breakdown, and reduce costs.

In case that a plurality of movement delay units 130 are disposed, for example, two movement delay units 130 may be provided in the movement hole 141 provided in the guide frame 140, and one movement delay unit 130 may be provided in the movement hole 141 and the other movement delay unit 130 may be provided in the cover side movement path 151. Also, one movement delay unit 130 may be provided in the base side movement path 161 and the other movement delay unit may be provided in the movement hole 141. The plurality of movement delay units 130 may be disposed to be spaced apart from one another. The disposition of the plurality of movement delay units 130 may be sequential. Also, the plurality of movement delay units 130 may be disposed to face each other so as to delay a movement of the mass body.

In the present embodiment, a configuration in which the movement delay unit 130 is provided in the movement hole 141 is illustrated. The movement delay unit 130 is disposed in the middle of the movement hole 141 continued to the second movement path 142 from the support bar 143.

Figure 2:
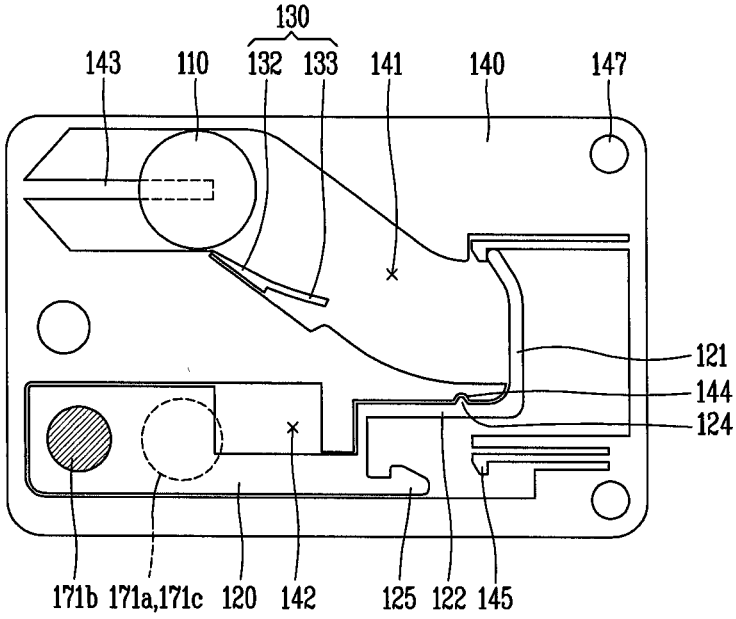
FIG. 2 is a conceptual view illustrating an assembled configuration of the munitions safety and arming device for artillery ammunition illustrated in FIG. 1.

FIG. 2 is a conceptual view illustrating an assembled configuration of the munitions safety and arming device 100 for artillery ammunition illustrated in FIG. 1 and is a plan view of the assembled configuration of the munitions safety and arming device 100 for artillery ammunition.

The mass body 110 is provided on the support bar 143 of the guide frame 140. Thus, a portion of the support bar is indicated by the dotted line, and a configuration indicated by the dotted line is a configuration positioned below the mass body 110. The mass body 110 is maintained at a corresponding position by the mass body holder 152 (refer to FIG. 1) provided in the cover 150 at an upper side of the mass body 110, without falling.

The movement hole 141 forming a portion of the first movement path in which the mass body 110 moves is sloped. The movement delay unit 130 is disposed at a portion where the sloping starts. Thus, when the mass body 110 is separated from the support bar 143 and starts to move in the movement hole 141, a time duration in which the mass body 110 moves is lengthened by the movement delay unit 130.

The movement delay unit 130 may include a deceleration portion 132 decelerating a movement speed of the mass body 110 and a constant velocity portion 133 maintaining a movement speed of the mass body 110 decelerated by the deceleration portion 132.

The slide member 120 is provided in the second movement path 142. As described above, the cover side explosive 171*a* and the base side explosive 171*c* are disposed to deviate from the slide member side explosive 171*b*. This is because, if the explosives are aligned, they are highly likely to be detonated by external force or according to any other situation.

Figure 3:
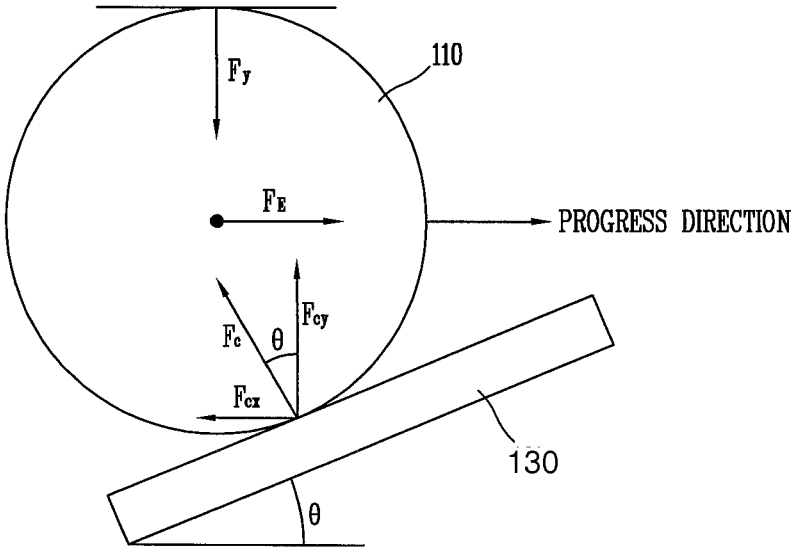
FIG. 3 is a conceptual view illustrating force exerted on a mass body when the mass body passes on a movement delay unit.

FIG. 3 is a conceptual view illustrating force exerted on the mass body 110 when the mass body 110 passes on the movement delay unit 130. Specifically, FIG. 3 shows a relation of force exerted when the mass body 110 meets the movement delay unit 130 at an angle θ from a surface of the first movement path.

When fired, the artillery ammunition rotates, and the mass body 110 receives centrifugal force $F_B$ by the rotation. Also, the mass body 110 receives force $F_C$ by the movement delay unit 130. In this case, the force exerted on the mass body 110 in a progress direction is expressed by Equation (1) below.

$$F_B - F_{cx} = mr\omega^2\sin\theta - \frac{3EI}{l^3} \times \sin\theta = ma \tag{1}$$

Here, I is a moment of inertia of the movement delay unit 130. In this case, when the value I increases, force Fcx exerted on the mass body 110 in a direction opposite the progress direction increases, decelerating the mass body 110.

Meanwhile, the moment of inertia I of the movement delay unit 130 may be calculated as expressed by Equation 2 below.

$$1 = \frac{wt^3}{12} = \frac{w(t_{0+}bl)^3}{12} \tag{2}$$

Here, w is a width (length) of the movement delay unit 130, and t is a thickness of the movement delay unit 130. Thus, in order to increase moment of inertia of the movement delay unit 130, the width of the movement delay unit 130 is may need to be increased or the thickness of the movement delay unit 130 may be increased. Also, as shown in Equation (1), force Fcx exerted to the mass body 110 by the movement delay unit 130 may be adjusted by increasing the angle θ between the movement delay unit 130 and a first movement path surface.

Thus, in order to decelerate a movement speed of the mass body 110 through the deceleration portion 132 or maintain a movement speed of the mass body 110 through the constant speed portion 133, a reduced speed or a constant speed may be maintained by changing at least any one of the thickness of the movement delay unit 130 or displacement of the movement delay unit 130 from the surface of the first movement path.

Also, a design of the constant speed section may be calculated by Equation (3) below.

$$F_B - F_{cx} = mr\omega^2\sin\theta - \frac{3EI}{l^3} \times \sin\theta = 0 \tag{3}$$

Here, force $F_B$ due to centrifugal force and force Fcx due to cantilever in the movement direction are equivalent, and thus, force exerted on the mass body is 0, enabling the mass body to make a uniform motion.

Figure 4:
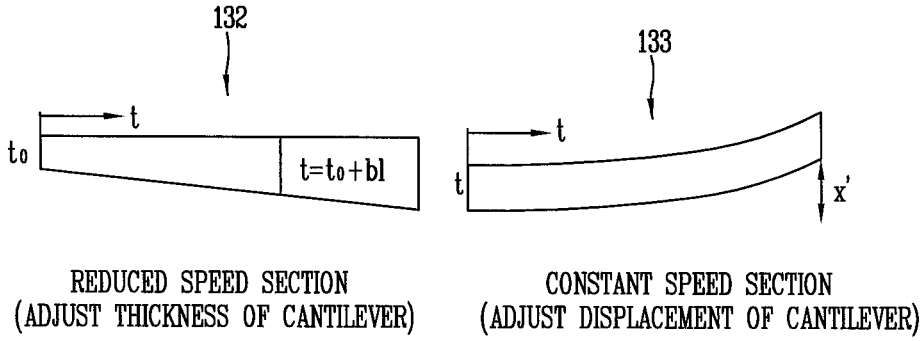
FIG. 4 is a conceptual view illustrating a deceleration part and a constant velocity portion of the movement delay unit according to the present invention.

FIG. 4 is a conceptual view illustrating a deceleration portion 132 and a constant velocity portion 133 of the movement delay unit 130 according to the present invention.

The thickness of the deceleration portion 132 (reduced speed section) is increased toward a movement direction of the mass body 110, increasing moment of inertia of the movement delay unit 130, increasing force opposite the centrifugal force exerted on the mass body 110.

Also, the constant speed portion 133 (constant speed section) is formed to have displacement increased from the first movement path, namely, the surface where the movement delay unit 130 is formed, toward a movement direction of the mass body 110. This is to increase the angle θ between the constant speed portion 133 and the first movement path.

Figure 5:
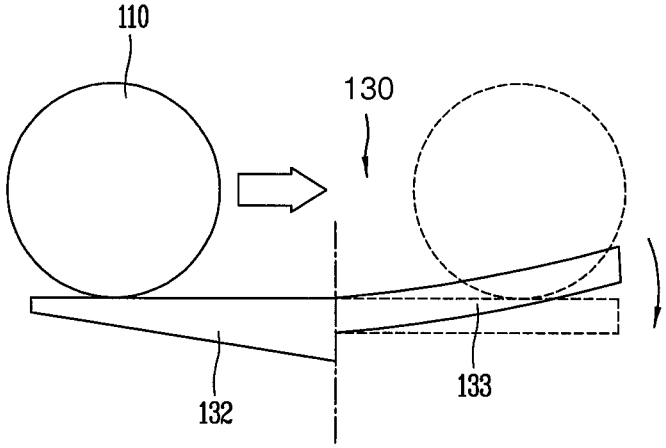
FIG. 5 is a conceptual view illustrating a configuration when the mass body passes on the movement delay unit according to the present invention.

FIG. 5 is a conceptual view illustrating a configuration when the mass body 110 passes on the movement delay unit 130 according to the present invention.

In the conceptual view, the movement delay unit 130 is illustrated to be flat, while the movement delay unit 130 is disposed to form a predetermined angle θ with the first movement path. When the mass body 110 passes on the movement delay unit 130, the thickness of the deceleration portion 132 increases, increasing force opposite the centrifugal force exerted on the mass body 110. When the force is greater than the centrifugal force exerted on the mass body 110, the speed of the mass body 110 is reduced. Also, the deceleration portion 132 may droop downwardly.

Also, in the constant speed portion 133, the thickness of the movement delay unit 130 is not increased but the displacement from the first movement path to the constant speed portion 133 is increased, and thus, when the movement body 110 moves, it needs to press the constant speed portion 133 to pass thereon. Thus, the force exerted by the mass body 110 on the constant speed portion 133 is traded off with the centrifugal force exerted on the mass body 110, and thus, the mass body 110 moves at a constant speed.

Figure 6:
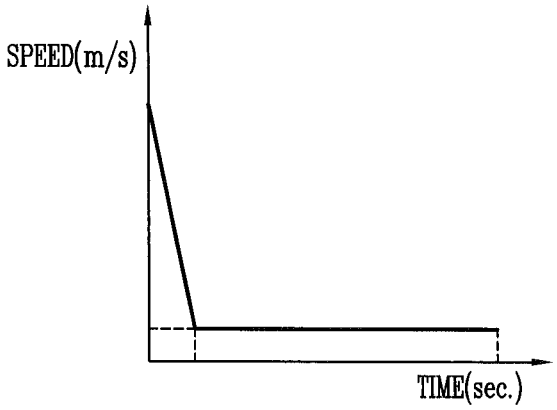
FIG. 6 is a conceptual view illustrating a change in speed when the mass body illustrated in FIG. 5 passes on the deceleration portion and the constant velocity portion of the movement delay unit.

FIG. 6 is a conceptual view illustrating a change in speed when the mass body 110 illustrated in FIG. 5 passes through the deceleration portion 132 and the constant velocity portion 133 of the movement delay unit 130.

When the mass body 110 passes on the deceleration portion 132 of the movement delay unit 130, a speed is reduced with the passage of time, and when the mass body 110 passes on the constant speed portion 133, the speed is uniformly maintained with the passage of time.

However, the mass body 110, when passing on the deceleration portion 132 or the constant speed portion 133, is not necessarily restricted to the speed-time graph but the speed of the mass body 110 may be slightly increased or reduced. This may be adjusted within a range in which the object for delaying the speed of the mass body 110 is achieved.

FIGS. 7A through 7E are conceptual views illustrating operational states of the mass body 110 according to the present invention when an artillery ammunition is fired.

Figure 7A:
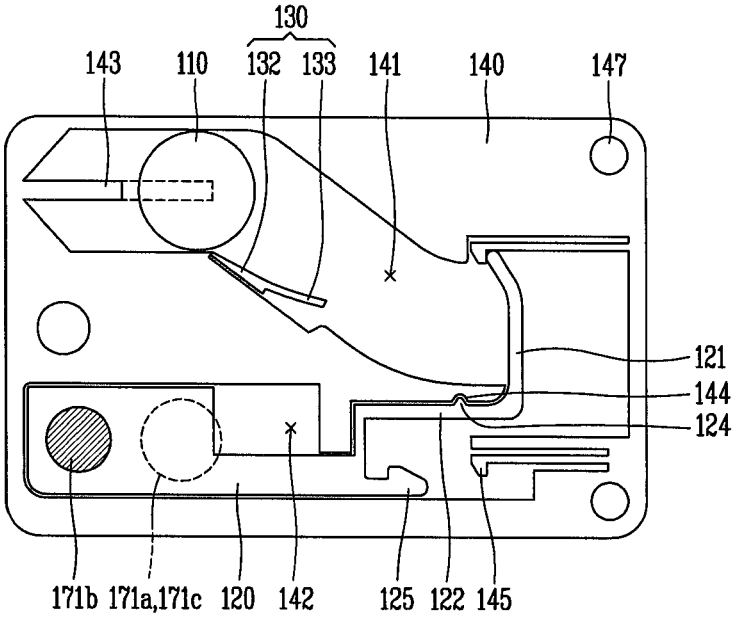
FIGS. 7A through 7E are conceptual views illustrating operational states of the mass body according to the present invention when an artillery ammunition is fired.

FIG. 7A illustrates a configuration immediately after an artillery ammunition is fired, When comparing FIG. 7A and FIG. 2, the linear length of the support bar 143 is shown to be shortened. The artillery ammunition including the munitions safety and arming device is fired upwardly based on the drawing (in a penetrating-out direction on the drawing) and the support bar 143 droops downwardly (in a penetrating-in direction on the drawing) due to the inertial force thereof.

Due to the drooping, the mass body 110 is released from the mass body 110 holder and housed to the first movement path, and may be in a state of moving according to a rotation of the artillery ammunition.

Figure 7B:
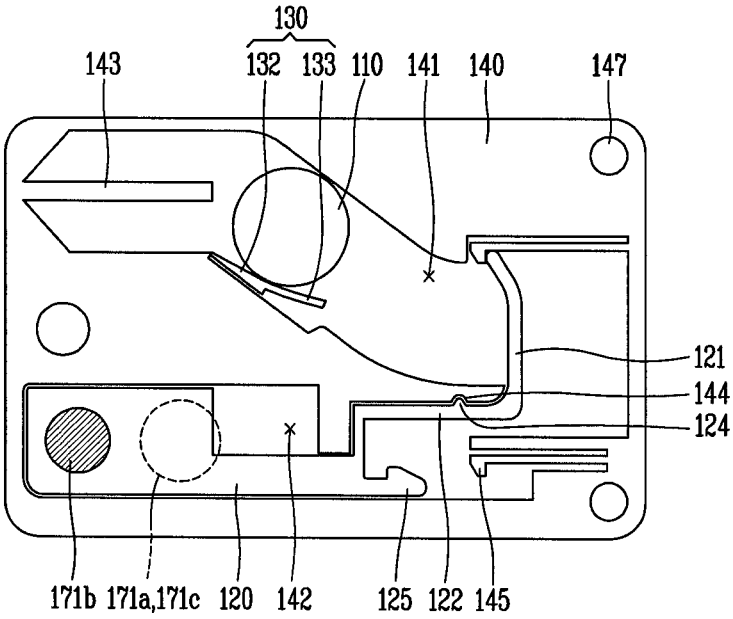

FIG. 7B illustrates a configuration in which the mass body 110 is moved by centrifugal force based on the rotation of the artillery ammunition.

The mass body 110 moves along the first movement path. While passing on the movement delay unit 130, the mass body 110 passes on the deceleration portion 132 and the constant speed portion 133. As the mass body 110 passes on the deceleration portion 132 and the constant speed portion 133, a movement speed thereof is reduced, resultantly reducing a time for the slide member 120 to move.

Figure 7C:
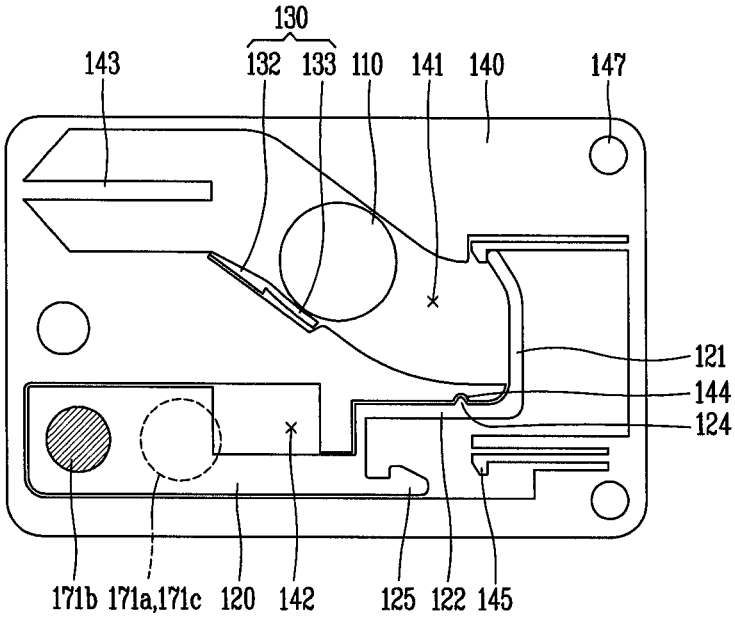

FIG. 7C illustrates a configuration in which the mass body 110 passes on the constant speed portion 133.

To move, the mass body 110 presses the constant speed portion 133, and thus, the constant speed portion 133 is bent downwardly. AS the mass body 110 makes the constant speed portion bent downwardly, centrifugal force exerted on the mass body 110 is canceled out, and thus, the mass body 110 moves at a uniform speed.

Also, the mass body 110 continues to move, it becomes away from a central portion of the artillery ammunition, and thus, force exerted on the mass body 110 is further increased. This is because the value r is increased in the centrifugal force FB exerted on the mass body 110 in Equation (1) or Equation (3).

Figure 7D:
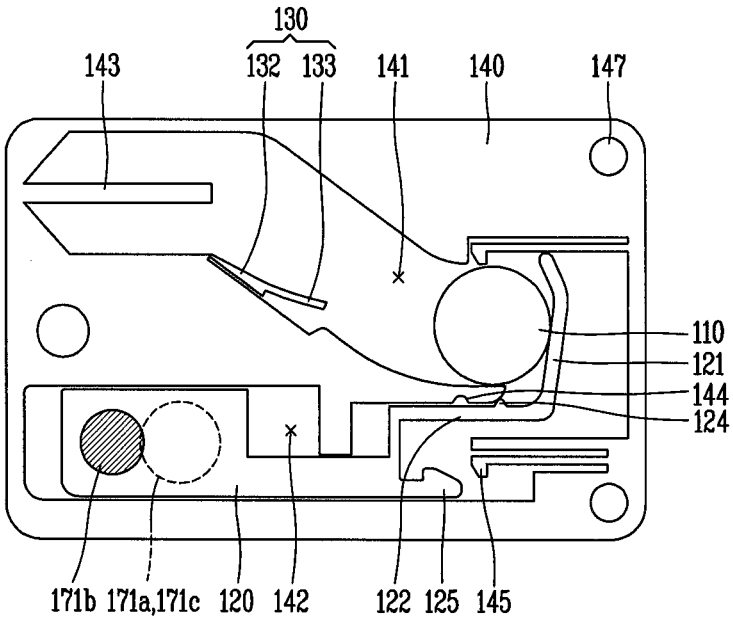
Figure 7E:
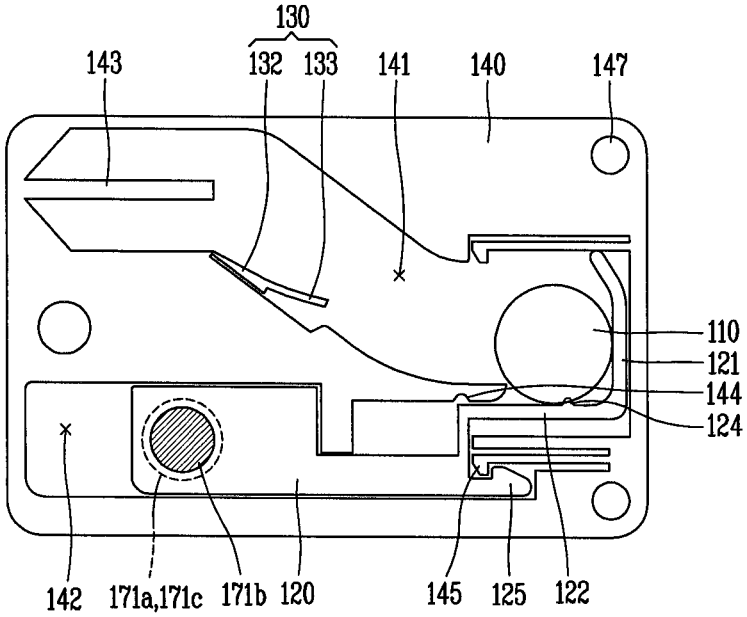

FIG. 7D illustrates a configuration in which the mass body 110 moves to meet the vertical bar 121 of the slide member 120.

The slide member 120 is temporarily fixed to the guide frame 140 by a stopping protrusion 124 and a stopping recess 144. Due to the presence of the stopping protrusion 124 and the stopping recess 144, the slide member 120 is fixed to the guide frame 140, without being moved by external force with which the artillery ammunition is moved and fired.

However, when the mass body 110 moves to press the vertical bar 121, the elastic vertical bar 121 is bent, and thus, the stopping protrusion 124 caught by the stopping recess 144 is released. As the stopping protrusion is released, the slide member 120 starts to move to the right.

FIG. 7 illustrates a configuration in which the slide member 120 has been completely moved by the mass body 110. Centrifugal force continuously exerts on the mass body 110, moving the slide member 120.

When the movement is completed, the slide member coupling portion 125 of the slide member 120 is coupled to the guide frame coupling portion 145. Thus, although the artillery ammunition collides with a target, or in spite of any other external force, the slide member 120 is not returned.

Also, as the movement is completed, the cover side explosive 171*a* and the base side explosive 171*c* disposed above and below the guide frame 140 and the slide member 120 side explosive disposed in the slide member 120 are aligned. Accordingly, the explosive is ready to be detonated within the artillery ammunition.

Figure 8:
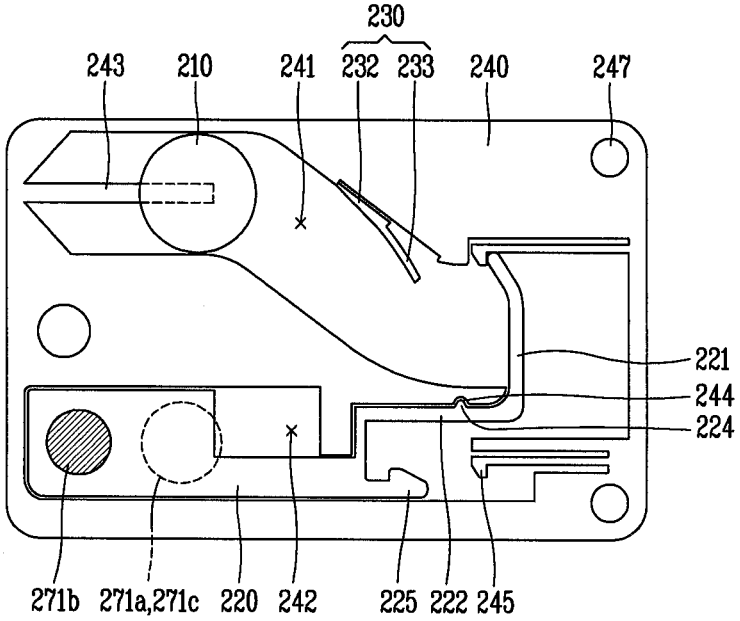
FIG. 8 is a conceptual view illustrating an assembled configuration of a munitions safety and arming device for artillery ammunition according to another embodiment of the present invention.

FIG. 8 is a conceptual view illustrating an assembled configuration of a munitions safety and arming device for artillery ammunition according to another embodiment of the present invention.

The munitions safety and arming device for artillery ammunition illustrated in FIG. 8 has components identical to those of the munitions safety and arming device for artillery ammunition illustrated in FIG. 2, except for a movement delay unit 230, and thus, a description thereof will be omitted.

In the present embodiment, the movement delay unit 230 is positioned above a guide frame. When the mass body 210 moves, the mass body 210 inevitably presses an upper portion of the movement delay unit 230, and thus, the movement of the mass body 210 is delayed.

However, the present invention is not limited to the foregoing embodiment, and as described above, the movement delay unit may be provided in the movement hole, the cover side movement path, and the base side movement path. Also, a plurality of movement delay units may be provided. When a plurality of movement delay units are provided, cantilevers respectively constituting the movement delay units may be spaced apart from one another in a row or may be respectively disposed in the movement hole, the cover side movement path, and the base side movement path, such that portions in contact with the mass body may partially overlap.

Figure 9:
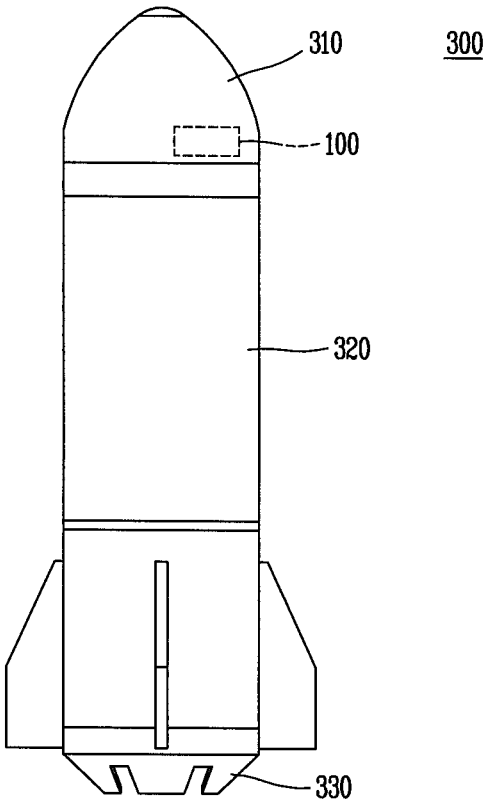
FIG. 9 is a conceptual view illustrating an artillery ammunition according to the present invention.

FIG. 9 is a conceptual view illustrating an artillery ammunition 300 according to the present invention.

Referring to FIG. 9, an artillery ammunition 300 includes an artillery ammunition body 310, 320, and 330, and the munitions safety and arming device 100 for artillery ammunition installed in the artillery ammunition body.

The artillery ammunition body may be divided into an upper portion 310, a middle portion 320, and the lower portion 330. Since the munitions safety and arming device 100 for artillery ammunition generally operates in association with a fuze, and thus, the munitions safety and arming device 100 for artillery ammunition is housed in the upper portion 310 of the artillery ammunition body. However, according to circumstances, the munitions safety and arming device 100 for artillery ammunition may be positioned in the middle portion 320 or the lower portion 330.

When the artillery ammunition is fired, the artillery ammunition rotates around a central portion of the body thereof as an axis, and centrifugal force based on the rotation moves the mass body inside the munitions safety and arming device 100 for artillery ammunition.

The munitions safety and arming device for artillery ammunition and the artillery ammunition having the same described above are not limited to the configurations and methods of the embodiments described above, but the entirety or a portion of the embodiments can be selectively combined to be configured into various modifications.

What is claimed is:

1. A munitions safety and arming device for artillery ammunition, the munitions safety and arming device comprising:

a body having a first movement path and a second movement path communicating with the first movement path;

a mass body housed in the first movement path, the mass body being moveable from a first end of the first movement path to a second end of the first movement path upon exertion of a centrifugal force based on rotation on an artillery ammunition when the artillery ammunition is fired, wherein the mass body is accommodated by the body;

a slide member movably installed in the second movement path, the slide member being moveable by a predetermined distance when pressed by the mass body, wherein the slide member comprises a vertical bar protruding into the first movement path; and a movement delay unit configured to delay a time for the mass body to move by reducing the centrifugal force exerted on the mass body, wherein the movement delay unit comprises:

a deceleration portion having a thickness increased from the first end of the first movement path to the second end of the first movement path to reduce a movement speed of the mass body in the first movement path; and a constant speed portion coupled to the deceleration portion, wherein the constant speed portion protrudes into the first movement path, such that a distance from a side wall of the first movement path to a surface of the constant speed portion is increased to maintain the movement speed of the mass body reduced by the deceleration portion.

2. The munitions safety and arming device for artillery ammunition of claim 1, wherein the body comprises:

a guide frame having a movement hole and the second movement path, the movement hole forming a portion of the first movement path;

a cover disposed on one side of the guide frame and having a cover side movement path forming another portion of the first movement path; and a base disposed on the other side of the guide frame and having a base side movement path forming said another portion of the first movement path, wherein the movement hole, the cover side movement path and the base side movement path overlap one another by coupling the guide frame, the cover and the base, to form the first movement path through which the mass body is movable, and wherein the movement delay unit is disposed in one of the guide frame, the cover side movement path, and the base side movement path.

3. The munitions safety and arming device for artillery ammunition of claim 2, wherein a plurality of movement delay units are provided and disposed to be spaced apart from one another.

4. The munitions safety and arming device for artillery ammunition of any one of claims 1 to 3, wherein the movement delay unit comprises a cantilever protruding from one side of the first movement path toward the other side thereof.

5. The munitions safety and arming device for artillery ammunition of claim 4, wherein the cantilever comprises the deceleration portion and the constant speed portion.

6. The munitions safety and arming device for artillery ammunition of claim 5, wherein in order to reduce the movement speed of the mass body through the deceleration portion or maintain the movement speed of the mass body through the constant speed portion, at least one of a thickness of the cantilever and a displacement from a surface of the first movement path to the cantilever is changed.

7. An artillery ammunition comprising:

an artillery ammunition body fired by propellant powder;

a body installed in the artillery ammunition body, a first movement path with a support bar that is bent when the artillery ammunition body is fired and a second movement path communicating with the first movement path;

a mass body supported by the support bar before the artillery ammunition body is fired, wherein the mass body is housed in the first movement path as the support bar is bent when the artillery ammunition is fired, wherein the mass body moves from a first end of the first movement path to a second end of the first movement path upon exertion of a centrifugal force based on rotation of the artillery ammunition body; and a slide member movably installed in the second movement path, wherein the slide member is temporarily supported in the body by a stopping protrusion, wherein the slide member is slidably moveable by a predetermined distance when pressed by the mass body, wherein the slide member comprising a vertical bar protruding into the first movement path, wherein the body comprises:

a guide frame having a movement hole and the second movement path, the movement hole forming a portion of the first movement path;

a cover disposed on one side of the guide frame and having a cover side movement path forming another portion of the first movement path; and a base disposed on the other side of the guide frame and having a base side movement path forming said another portion of the first movement path; and a movement delay unit configured to delay a time for the mass body to move by reducing the centrifugal force exerted on the mass body, wherein the movement delay unit comprises:

a deceleration portion having a thickness increased from the first end of the first movement path to the second end of the first movement path to reduce a movement speed of the mass body in the first movement path; and a constant speed portion coupled to the deceleration portion, and protruded into the first movement path such that a distance from a side wall of the first movement path to a surface of the constant speed portion is increased to maintain the movement speed of the mass body decelerated by the deceleration portion, wherein the movement hole, the cover side movement path and the base side movement path overlap one another by coupling the guide frame, the cover and the base, to form the first movement path through which the mass body is movable, and wherein the movement delay unit is disposed in one of the guide frame, the cover side movement path, and the base side movement path.

* * * * *